United States Patent [19]

Stranahan

[11] 4,074,649

[45] Feb. 21, 1978

[54] ICE BARRIER FOR BOATS

[76] Inventor: Robert L. Stranahan, 2403 Limestone Road, Wilmington, Del. 19808

[21] Appl. No.: 793,720

[22] Filed: May 4, 1977

[51] Int. Cl.[2] ..... B63B 59/02

[52] U.S. Cl. ..... 114/219; 61/103

[58] Field of Search ..... 61/1 R, 1 F, 54, 103; 114/219, 270, 40, 41, 42, 67 R

[56] References Cited

U.S. PATENT DOCUMENTS

| | | | |
|---|---|---|---|
| 938,645 | 11/1909 | Davis | 114/219 |
| 3,050,750 | 8/1962 | Harrison | 114/219 |
| 3,476,246 | 11/1969 | Dahan | 61/1 F |
| 3,798,912 | 3/1974 | Best | 61/103 |
| 3,949,697 | 4/1976 | Veda | 114/219 |
| 3,972,199 | 8/1976 | Hudson | 61/103 |

*Primary Examiner*—Trygve M. Blix
*Assistant Examiner*—D. W. Keen
*Attorney, Agent, or Firm*—Charles A. Weigel, Jr.

[57] ABSTRACT

An ice barrier for the wet storage of boats is formed of a plurality of notched, elongated elements bridled about a boat hull at waterline. These elements are compressible and their outside surfaces form a V-type groove parallel to and located at the boat's waterline. In this manner, forming ice engages the elements in the notched regions and tends to lock them at that level so that they are not easily dislodged from their protective position. Any movement of the elements with the natural rocking of the boat, cooperating with the notch, aids in breaking the ice.

10 Claims, 4 Drawing Figures

ICE BARRIER FOR BOATS

BACKGROUND OF THE INVENTION

This invention relates to an ice barrier for the wet storage of boats and, more particularly, to an ice barrier which is locked onto the forming ice to afford a more sure protection for the boat's hull.

Many techniques have been used to permit the wet (in water) storage of boats during the winter season without the boat hull incurring ice damage during freezing and thawing. Among these have been heating the water surrounding the boat, enveloping the boat hull in air bubbles which tend to prevent the formation of ice and, finally, barriers floating on the water which seek to insulate the boat from the damaging effects of ice. While practical in concept, these barriers have proven to be most ineffective for the simple reason that the forming ice tends to literally push the barriers out of the way and form directly against the hull of the boat.

Thin ice is particularly damaging to the boat hull since, as the boat rocks on its lines due to the wind, current and tides, the thin ice cuts the finish, as well as the gelcote on fiberglass boats, or shreds the wood on a wooden hull boat. As the ice successively freezes, thaws, and refreezes with the varying dropping temperatures, the ice gradually increases in thickness. As the water continues its freezing and thickens still more, it builds up tremendous pressures which are exerted against the hull of the boat. This is particularly damaging to the boat's vertical surfaces and at times can cause the hull to be crushed in places.

Accordingly, it is an object of this invention to provide an improved ice barrier for the wet storage of boats.

SUMMARY OF THE INVENTION

According to this invention, an ice barrier for permitting the wet storage of boats and other floating objects during freezing weather includes a compressible member having first and second opposite faces, the first face being flat and adapted to contact a portion of a boat at its waterline, the second face defining a horizontally disposed notched region, and means to secure the member to a boat with the notched region at the waterline.

In a preferred embodiment of the invention, the member is configured and has a density such that it floats in water with the notched region located at the surface of said water, whereby forming ice can engage the member in the notched region. This aids in locking the member in position with the member being between the ice and the side of the boat so that the member is not easily dislodged.

In a particularly preferred embodiment of the invention, a second face is defined in perpendicular cross-section by upper and lower intersecting convex contours, such as semicircles, with the radius of the upper semicircle being less than the radius of the lower semicircle. Several members are used to protect a boat and are held in end-to-end relationship about the boat at the waterline.

This barrier in use aids in locking the barrier to the ice itself, aiding in cutting the ice as the boat rocks, forming a cradle for the boat when the ice becomes solid, and compresses to prevent damage to the sides of the boat as the ice expands. When the material is formed or coated to have a black color, the black absorbs heat more readily and aids in the melting of the ice in the immediate vicinity of the boat.

BRIEF DESCRIPTION OF THE DRAWINGS

Further advantages and features of this invention will become apparent upon consideration of the following description wherein.

DETAILED DESCRIPTION OF THE PREFERRED EMBODIMENTS

Figure 1:
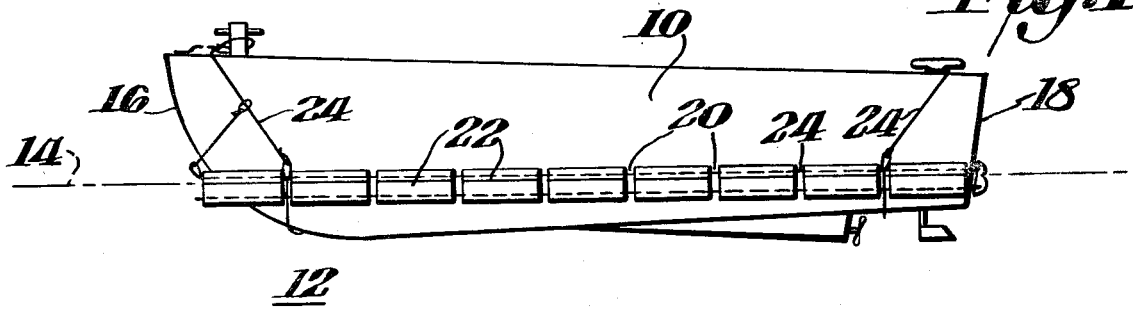
FIG. 1 is a side elevation view of a boat floating in the water protected by ice barriers constructed and bridled to the boat in accordance with this invention.

There may be seen, with reference to the drawings and with particular reference to FIG. 1, a boat 10 floating in water 12 up to a waterline 14. The boat has a prow 16, a stern 18 and sides 20 (only one being visible). Attached or bridled to the boat are a plurality of barriers 22 constructed in accordance with this invention. Preferably, these barriers are elongated along the horizontal direction. The barriers are bridled as by lines 24 which are attached or strung over the top of the boat 10. In addition, lines 24 are run through each barrier 22 so as to maintain the barriers in an end-to-end relationship along the boat sides 20, prow 16, and stern 18 of the boat, as depicted particularly in FIG. 1.

Figure 2:
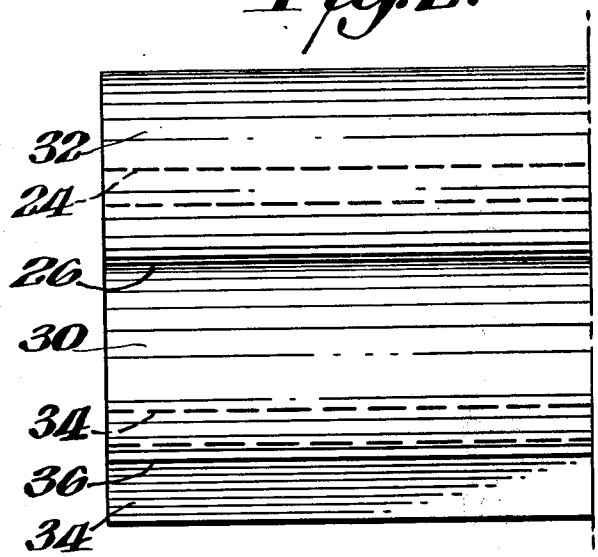
FIG. 2 is a side elevation view of a single ice barrier of the type depicted in FIG. 1.
Figure 3:
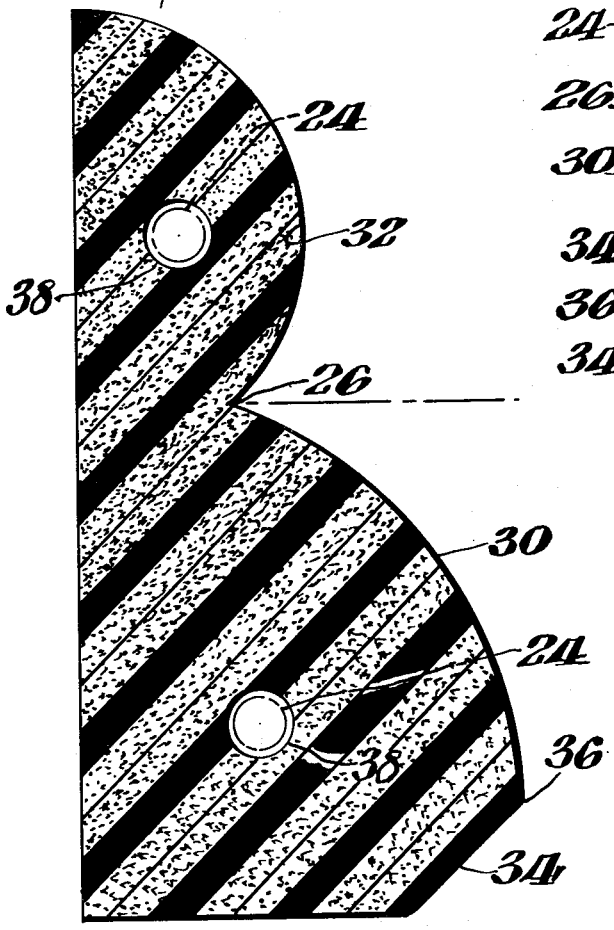
FIG. 3 is a cross-sectional elevation view of the ice barrier illustrated in FIG. 2.

Each barrier 22, as may be seen in FIGS. 2 and 3, is elongated in the horizontal sense and defines a horizontally extending notched region 26. The barrier is configured such that its shape and density permit it to float with the waterline 14 contacting the barrier approximately at the notched region 26. The barrier itself may be formed of any suitable compressible material that will float, at least partially float, such as polyether or polyester urethane foam or cork. The foam may be rigid or flexible so long as it is permitted to compress under the extreme pressures exerted by the ice. Other materials that also can be used are wood, although this is not as suitable since most woods do not compress well, or polystyrene plastic. Desirably, the water level should be either at the notched region 26 or certainly within a short distance either side thereof. Preferably, the waterline should not vary much more than ten percent of the total vertical height of the barrier on either side of the notch 26.

In the preferred embodiment of the invention, the barrier is constructed of polyester urethane foam of about 50 lb./cu. ft. density with the notch being defined by the outside surface forming two convex horizontally disposed regions 30 and 32, respectively. The convexity may be defined by any conic section, but preferably is an arc of a circle. In one preferred construction, by way of example, the upper region 32 is semicircular and has a radius of about 3 inches and an arcuate length of about 135° from the top. The lower region 30 is semicircular also having a radius of about six inches such that the intersection of these two radial semicircular portions define the notch 26. Each barrier, so constructed, may be in 4 foot lengths.

The bottom outside corner 34 may be cut off so as to define a ridge or edge 36 which has a function that will be described hereinafter. Longitudinal, horizontal bores 38 are formed in the upper and lower portions 32, 30 of the barrier extending through the entire length of the barrier such that lines 24 may pass therethrough and maintain the barrier in position relative to the other barriers, i.e., in end-to-end relationship. The only real requirement of the convex sections that form the notch is that the lower section have a greater radius, i.e., be larger, than the upper section. For the semicircular regions having the exemplary radial dimensions given, the total vertical heighth of the barrier is about 12 inches. The particular dimensions are not critical so long as the entire vertical height is sufficient to accommodate the normal ice thickness that will be encountered in the geographical region in which the barrier is to be used. Of course, size may also be varied according to boat size. The density of the foam may be varied by molding it with glass beads, sand, and the like in accordance with known techniques. The sand or other high density material is totally encapsulated and does not harm the side of the boat under normal conditions.

In operation, the individual barriers 22 of this invention is bridled or strung end-to-end along the side of the boat 10 by the lines 24 as depicted in FIG. 1 with the elongated notches 26 facing outwardly floating approximately at the waterline. Now as the boat moves up and down on its lines due to the wind, tide and/or current, any thin ice that forms is gripped by the notched region 26 and forced up and down until the ice breaks. Each time the ice freezes and is broken and again refreezes (from whatever cause), the ice gradually increases in thickness freezing downwardly. Thus, until a degree of cold persists for a relatively long period of time, thenormal action of the boat because of its use of the notch tends to maintain the thin ice broken in which state it can do little harm to the boat.

As the ice increases more in thickness, the natural movement of the boat is no longer sufficient to cause the ice to break. If the ice continues to form, it will gradually grip, freezing downwardly, the lower portion of each barrier 22. Eventually, it will lock each barrier in place along the side of the boat with the barrier between the ice and the boat. By the utilization of the larger radius for the lower portion, the downward forces caused by the ice acting on the lower surface will exceed any upward pressures on the smaller upper surface so that the barrier is locked in position and the ice is unable to force it out of the way. The barrier remains between the boat and the ice. Finally, the boat rests upon a foam barrier locked into the ice and well protected from the ravages of the ice flow. As the ice continues to thicken, it reaches the point of the ridge or edge 36 and forms therearound continuing to still more firmly lock the barrier in position to the ice so that the barrier cannot be forced out of place. Each barrier is gripped at the notch 26 as well as at the ridge 36.

As the cold and the freezing continues, the ice tends to expand more, exerting horizontal pressures against the boat hull. These pressures are now averted by the ability of the barrier itself to compress with the increased ice force, thereby easing the pressure particularly against the vertically oriented stern 18 of the boat. Hence, structural damage to the boat hull due to compression is reduced.

Finally, by forming the barrier out of a black material, any heat received from the sun's reflection off the ice and the sun itself is quickly used to melt the ice first in the immediate vicinity of the boat hull, thereby further alleviating any damage to the boat.

In short, the barrier is seen to utilize the notch to aid in breaking thin ice, as well as to lock the barrier in position so that it is not easily diverted upwardly or downwardly out of its proper position. With freezing, the barrier is further locked by the lower edge 36 and throughout serves as a compression barrier between the hull of the boat and the ice flow.

In alternative embodiments, the upper and lower sections, which form the notch, need not define conical sections or be circular. As noted, they may be formed of other curved configurations and, in fact, may define any conic section of the two of which intersect to form the V-shaped groove. For that matter, the groove need not be precisely V-shaped; its apex may be rounded, if desired. Furthermore, the angle of intersection defined by the V-groove is not critical, although angles approximately 80° are generally preferred. The lower portion of the barrier must afford a greater surface with a downward slant than the upper portion so that the greater pressure acting on the barrier from the ice is in a downward sense. This downward motion, however, is blocked by the upper portion so that the barrier is not forced under water by the action of the ice.

Figure 4:
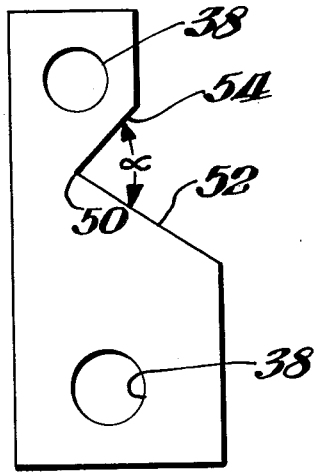
FIG. 4 is an end elevation view of an alternative form of ice barrier that may be used in accordance with this invention.

In an alternative form of the invention, a barrier is depicted in cross-section in FIG. 4. Otherwise, construction is substantially the same as that described in connection with FIGS. 2 and 3. In this embodiment, the barrier defines a V-shaped, horizontally extending, outwardly opening groove 50 with planar walls. The longitudinal bores 38 are formed in the upper and lower portions of the barrier as previously described. The V-shaped groove 50 has a downwardly and outwardly sloping lower surface 52 which, as may be seen, has a greater surface area than the upwardly and outwardly directed upper surface 54. Desirably, the surface 54 forms an angle with the horizontal which should not greatly exceed 45° at the notch. With the curved surfaces, this angle will be exceeded away from the region of the notch. The angle $\alpha$ between these surfaces may vary in any of the embodiments described thus far from as little as about 45° to as great as about 130° although the extremes of this range are not preferred since they decrease the ability of the barrier to both break the ice and to form an adequate lock with the ice if the ice totally freezes. The preferred angle $\alpha$ is about 85° as previously noted. Hence, it is sufficient that the V-groove merely be formed in the upper portion of the barrier and that the lower sloping surface 52 area exceed the surface area of the upper portion 54 of the V-groove.

Its function is precisely the same as that just described and hence need not be repeated. As previously noted, the V-groove may be more U-shaped or have a rounded apex. Further, the ends of the barrier may be united at the corners or prow of the boat. While spaces are shown between the barriers for ease of illustration, actually the barriers may butt each other end-to-end in close proximity.

I claim:

1. An ice barrier for permitting the wet storage of boats during freezing weather comprising, in combination:

a member formed of a compressible material and having first and second opposite faces;

said first face being generally flat and adapted to contact a portion of a boat at its waterline;

said second face defining a horizontally disposed, notched region; and means to secure said member to a boat with said notched region at said waterline.

2. An ice barrier according to claim 1 wherein said member is configured and has a density such that it floats in water with said notched region at the surface of said water, whereby forming ice can engage said member in said notched region.

3. An ice barrier according to claim 2 wherein said second face is defined in perpendicular cross-section by upper and lower intersecting convex contours.

4. An ice barrier according to claim 3 wherein said contours are semicircles.

5. An ice barrier according to claim 4 wherein the radius of said upper semicircle is less than the radius of said lower semicircle.

6. An ice barrier according to claim 5 wherein the lower portion of said second face is cut off to define a protuberant edge for engaging forming ice.

7. An ice barrier according to claim 2 wherein said notched region is defined by a V-groove.

8. An ice barrier according to claim 7 wherein said V-groove is asymmetrical with the lower portion having a greater surface area than the lower portion.

9. An ice barrier according to claim 1 wherein said compressible member is elongated along said waterline, and said barrier is comprised of a plurality of said members in elongated end-to-end relationship.

10. An ice barrier according to claim 9 wherein said members are black.

* * * * *